US005979382A

United States Patent [19]

Heer

[11] Patent Number: 5,979,382

[45] Date of Patent: Nov. 9, 1999

[54] DEVICE FOR ADJUSTING THE PHASE ANGLE OF A CAMSHAFT OF AN INTERNAL COMBUSTION ENGINE

[75] Inventor: Siegfried Heer, Kirchdorf/Krems, Austria

[73] Assignee: TCG Unitech Aktiengesellschaft, Kirchdorf/Krems, Australia

[21] Appl. No.: 09/154,337

[22] Filed: Sep. 16, 1998

[30] Foreign Application Priority Data

Sep. 19, 1997 [AT] Austria ..... 1586/97

[51] Int. Cl.[6] ..... F01L 1/344

[52] U.S. Cl. ..... 123/90.17; 123/90.31

[58] Field of Search ..... 123/90.15, 90.17, 123/90.31; 74/568 R; 464/1, 2, 160

[56] References Cited

U.S. PATENT DOCUMENTS

| | | | |
|---|---|---|---|
| 3,978,829 | 9/1976 | Takahashi et al. | 123/90.15 |
| 4,561,390 | 12/1985 | Nakamura et al. | 123/90.15 |
| 4,967,701 | 11/1990 | Isogai et al. | 123/90.11 |
| 5,111,780 | 5/1992 | Hannibal | 123/90.17 |
| 5,117,784 | 6/1992 | Schechter et al. | 123/90.17 |
| 5,365,898 | 11/1994 | Mueller | 123/90.17 |
| 5,509,384 | 4/1996 | Schmid | 123/90.17 |
| 5,673,659 | 10/1997 | Regueiro | 123/90.17 |
| 5,803,030 | 9/1998 | Cole | 123/90.17 |

FOREIGN PATENT DOCUMENTS

| | | |
|---|---|---|
| 0596860 | 5/1994 | European Pat. Off. . |
| 3320835 | 12/1984 | Germany . |
| 3607256 | 9/1987 | Germany . |
| 3929619 | 3/1991 | Germany . |
| 4101676 | 7/1992 | Germany . |
| 4110088 | 7/1992 | Germany . |
| 2221513 | 2/1990 | United Kingdom . |

*Primary Examiner*—Weilun Lo

*Attorney, Agent, or Firm*—Watson Cole Grindle Watson, P.L.L.C.

[57] ABSTRACT

A device for adjusting the phase angle of a camshaft of an internal combustion engine relative to the camshaft driving gear, includes an adjusting element which engages with both a member supporting the drive gear and a member rigidly connected to the camshaft, an axial movement of the adjusting element effecting a turning of the camshaft relative to its drive gear, and further including an electric motor for axially displacing the adjusting element, which motor is rigidly connected to the camshaft and is supplied with power through slip rings. Reliable adjustment is obtained in a simple manner by providing the adjusting element with a first threaded section which meshes with a threaded section of the member rigidly connected to the camshaft, and a second threaded section which meshes with a threaded section of the member supporting the camshaft drive gear.

7 Claims, 1 Drawing Sheet

DEVICE FOR ADJUSTING THE PHASE ANGLE OF A CAMSHAFT OF AN INTERNAL COMBUSTION ENGINE

BACKGROUND OF THE INVENTION

The invention relates to a device for adjusting the phase angle of a camshaft of an internal combustion engine relative to the camshaft driving gear, including an adjusting element which engages with both a member supporting the drive gear and a member rigidly connected to the camshaft, an axial movement of the adjusting element effecting a turning of the camshaft relative to its drive gear, and further including an electric motor for axially displacing the adjusting element, which motor is rigidly connected to the camshaft and is supplied with power through slip rings.

DESCRIPTION OF THE PRIOR ART

To obtain optimum values for fuel consumption and exhaust emissions in different regions of the engine operating characteristics, the valve timing must be varied in dependence of different operating parameters. An elegant manner of varying the valve timing is realized by rotating the camshaft relative to its driving gear. The camshaft of an internal combustion engine usually is driven by a sprocket wheel which is connected to the crankshaft via a drive chain, or a drive gear configured as a pulley which is connected to the crankshaft via a toothed belt.

In GB 2 221 513 A a camshaft adjusting mechanism is described where an electric motor operates a set of link arms turning the camshaft relative to its driving gear. For this purpose an actuating element carrying the pivoted arms is shifted in axial direction. This solution involves considerable expense and play on account of the large number of bearings.

In DE 41 10 088 C1 and DE 39 29 619 A1 adjusting mechanisms are described where an adjusting element is provided between a member connected with the camshaft and a member connected with the drive gear, which element has two helical threads meshing with corresponding threads of the camshaft or the drive gear. By axially displacing this adjusting element the camshaft can be turned relative to its drive gear. Axial displacement of the adjusting element may be obtained by actuation of a hydraulic plunger which is operated in dependence of the desired adjustment. The disadvantage of this solution is that the forces required can only be attained with a large hydraulic plunger necessitating considerable constructional expense. Moreover, a comparatively large amount of oil is required for operation of the plunger, which will necessitate a suitably sized pump and thus add to the engine load. As a further drawback of this known type of mechanism, adjustment of the camshaft is possible only between two extreme positions.

An electric adjusting device is presented in DE 41 01 676 A1 where an electric motor is provided for displacing the adjusting element by means of a threaded spindle. As the adjusting element rotates essentially at camshaft speed, an axial thrust bearing must be provided between the electric motor and the adjusting element, which takes up the relative movement between the non-rotating and the rotating member. In the above solution the thrust bearing is more or less permanently subject to load, as the torsional moments acting between drive gear and camshaft will produce a force acting on the adjusting element in axial direction. For this reason the thrust bearing is a critical component which will limit the useful life of the engine. A similar solution is described in DE 33 20 835 A1, where the same disadvantages are encountered.

In DE 36 07 256 A a mechanism is described, where a stepping motor is provided for adjustment of the camshaft, which is connected to both camshaft and drive gear. As the stepping motor must take up the entire driving torque for the camshaft, such a solution cannot be achieved within reasonable limits of expense.

SUMMARY OF THE INVENTION

It is an object of this invention to further develop a mechanism of the above type such that safe and reliable adjustment of the camshaft is achieved with comparatively simple means, without impairing the useful life of the engine.

In accordance with the invention this object is achieved by providing the adjusting element with a first threaded section, which meshes with a threaded section of the member rigidly connected to the camshaft, and a second threaded section, which meshes with a threaded section of the member supporting the drive gear.

It is an essential feature of the invention that the electric motor principally rotates together with the camshaft and that due to the large gear reduction ratio effected by the two threaded sections the electric motor is subject to comparatively small torque loads. In this way it is also possible to omit the complex transmission of the operating force from a non-rotating electric motor to the rotating camshaft.

The system proposed by the invention is self-locking, thus eliminating the possibility of unwanted phase variations. It does not require rolling bearings to take up the speed of the camshaft. The rolling bearings of the system itself all rotate together with the camshaft and have to cope only with the rotation of the electric motor.

It is provided in a preferred variant of the invention that the camshaft is connected to a flange, and that the electric motor is connected to a casing, and that the flange and the casing are rigidly connected by means of fastening elements passing through the drive gear. This will result in a particularly compact design. The fastening elements connecting the flange to the casing are constituted by bolts, which pass through arc-shaped, oblong holes in the drive gear.

In an alternative version of the invention the proposal is put forward that the electric motor should be rigidly connected to the drive gear and be supplied with power via slip rings. In this variant the electric motor may be flange-mounted directly on the drive gear, which will simplify construction. The housing of the electric motor will not rotate precisely at the speed of the camshaft, but rather at the speed of the drive gear; in practice, this will make no noticeable difference.

It will be an advantage to provide the driving shaft of the motor with a threaded section with helical teeth, which meshes with a threaded section of the adjusting element. In this way a very large gear reduction ratio is effected between a fast-running electric motor and a corresponding axial movement of the adjusting element.

Advantageously, the electric motor is configured as a stepping motor, as this will facilitate energization and ensure reliable operation. Depending on the structural layout it may be of advantage to configure the electric motor as a geared motor. Due to the integrated reducing gear a fast-running electric motor with very small torque may be used.

DESCRIPTION OF THE DRAWING

The invention will now be described further, by way of example, with reference to the accompanying drawing, in which.

Figure 1:
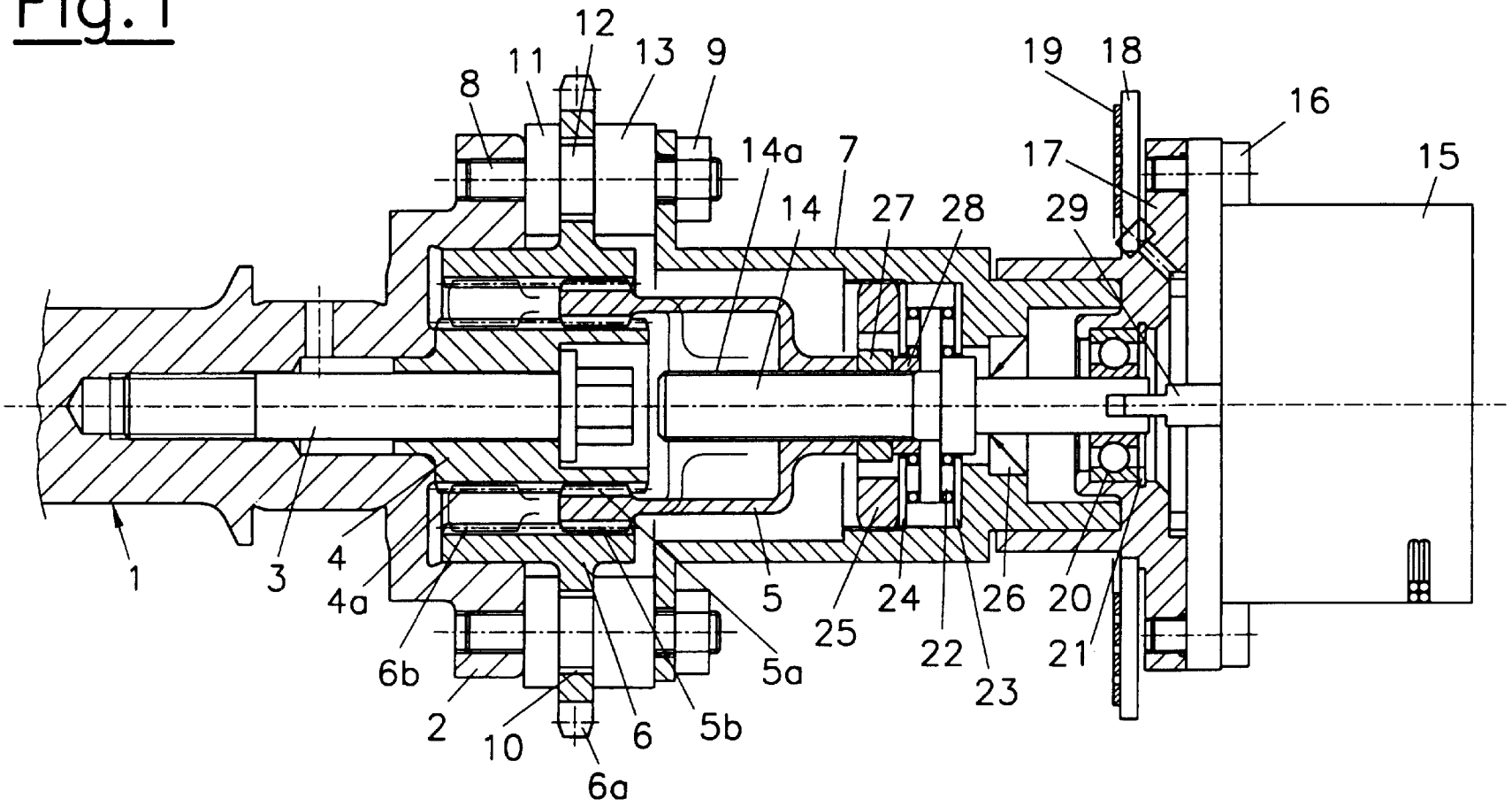
FIG. 1 is a section through a variant of the invention.

A camshaft (not shown here in detail) of an internal combustion engine is provided with a flange 2 at one end. By means of a bolt 3 a camshaft driving member 4 is rigidly connected to the camshaft 1. Via a helically toothed threaded section 4*a* on its outer circumference the member 4 engages with a threaded section 5*a* of the adjusting element 5. The adjusting element 5 fits over the member 4 and is in turn provided with a threaded section 5*b* on its outer circumference. This threaded section 5*b* meshes with a threaded section 6*b* of the drive gear 6 of the camshaft 1, which is configured as a sprocket wheel. The teeth 6*a* of the sprocket wheel 6 engage in a drive chain not shown. The drive chain will ensure a precisely defined position of the drive gear 6 relative to the crankshaft (also not shown). The inner threaded section 5*a* of the adjusting element 5 is threaded in opposite direction to the outer threaded section 5*b*, such that an axial movement of the adjusting element 5 will effect a turning of the camshaft 1 relative to the drive gear 6. A casing 7 is rigidly connected to the flange 2 of the camshaft 1. The connection is established with threaded bolts 8 which are screwed into the flange 2 and fastened on the casing 7 by means of nuts 9. The threaded bolts 8 pass through bores 10 in the drive gear 6, which bores 10 are configured as long holes in the form of circular arcs. Distance washers 11, 12, 13 will establish an accurately defined distance between the casing 7 and the flange 2. Washer 12 is smaller than the width of the long hole 10, whilst washers 11 and 13 have larger diameters. The width of washer 12 corresponds precisely to the thickness of the drive gear 6 in this part, which will ensure that there is no play in the axial position of the drive gear. A spindle 14 has an external thread 14*a* for engagement with the adjusting element 5. The spindle 14 is driven by an electric motor 15 which is rigidly connected to the casing 7. Connection is established by means of screws 16 attaching the electric motor 15 to a connecting part 17 fastened to the casing 7. A slip ring plate 18, which is rigidly attached to the electric motor 15, carries slip rings 19 for the current supply of the electric motor 15. The spindle 14 is supported by a rolling bearing 20 in radial direction relative to part 17. A snap ring 21 secures the outer ring of the rolling bearing 20. In axial direction the spindle 14 is held in position by an axial bearing 22. The axial bearing 22 rests on a washer 23 contiguous with a shoulder of the casing 7, and on a washer 24 secured to the casing 7 by a nut 25. A rotary shaft seal 26 prevents engine oil from leaking into the electric motor 15. On its outside the shaft seal 26 is secured to the casing 7. Via a sleeve 28 a nut 27 defines the precise axial position of the spindle 14 relative to the axial bearing 22.

In the variant of the invention presented in the drawing the motor 15 is rigidly connected to the camshaft 1. If current is passed through the motor the output shaft 29 of the motor 15 will turn the spindle 14. By turning the spindle 14 relative to the camshaft 1 the adjusting element 5 will be moved along the threaded section 14*a* in axial direction, for example, to the left in FIG. 1. This movement will cause a turning of the member 4 relative to the drive gear 6 on account of the sections with opposite threads 4*a*/5*a* and 6*b*/5*b*. In this manner the phase angle of the camshaft 1 is adjusted relative to the drive gear 6. In order to separate the electric motor 15 completely from the oil chamber of the engine, a further rotary shaft seal (not shown in this drawing) must be provided on the outside of the casing 7. This seal is integrated in the outside of a suitable partition (also not shown). On account of the large transmission ratio of the electric motor 15 a comparatively small torque will suffice to obtain a reliable adjustment.

The present invention will permit variation of the valve timing in an internal combustion engine in a simple and reliable manner. As a special advantage it will permit selection of any intermediate positions desirable.

I claim:

1. Device for adjusting the phase angle of a camshaft of an internal combustion engine relative to the camshaft drive gear, comprising an adjusting element which engages with both a member supporting the drive gear and a member rigidly connected to the camshaft, an axial movement of the adjusting element effecting a turning of the camshaft relative to the drive gear, and further comprising an electric motor for axially displacing the adjusting element, which motor is rigidly connected to one of the camshaft and the drive gear and is supplied with power through slip contacts, wherein the adjusting element is provided with a first threaded section which meshes with a threaded section of the member rigidly connected to the camshaft, and a second threaded section which meshes with a threaded section of the member supporting the drive gear.

2. Device as claimed in claim 1, wherein the camshaft is connected to a flange, and wherein the electric motor is connected to a casing, and wherein the flange and the casing are rigidly connected by means of fastening elements passing through the drive gear.

3. Device as claimed in claim 1, wherein the driving shaft of the motor is provided with a threaded section with helical teeth, which meshes with a threaded section of the adjusting element.

4. Device as claimed in claim 1, wherein the first threaded section and the second threaded section are arranged on the inside and outside, respectively, of a hollow cylindrical body.

5. Device as claimed in claim 1, wherein the electric motor is configured as a stepping motor.

6. Device as claimed in claim 1, wherein the electric motor is configured as a geared motor.

7. Internal combustion engine, wherein is provided a device as claimed in claim 1.

* * * * *